US005538238A

United States Patent [19]

Filsinger

[11] Patent Number: 5,538,238

[45] Date of Patent: Jul. 23, 1996

[54] SHEET-FEED FOR PRINTING PRESSES

[75] Inventor: Karl-Heinz Filsinger, Wiesloch, Germany

[73] Assignee: Heidelberger Druckmaschinen AG, Heidelberg, Germany

[21] Appl. No.: 232,105

[22] PCT Filed: Jun. 30, 1993

[86] PCT No.: PCT/EP93/01684

§ 371 Date: Jun. 28, 1994

§ 102(e) Date: Jun. 28, 1994

[87] PCT Pub. No.: WO94/05575

PCT Pub. Date: Mar. 17, 1994

[30] Foreign Application Priority Data

Aug. 28, 1992 [DE] Germany ..... 42 28 616.6

[51] Int. Cl.[6] ..... B65H 1/30

[52] U.S. Cl. ..... 271/159; 271/158

[58] Field of Search ..... 271/159, 158, 271/157; 414/795.8, 790.8

[56] References Cited

U.S. PATENT DOCUMENTS 3,137,498 6/1964 Siebke ..... 271/159
3,269,725 8/1966 Schwebel ..... 271/159
3,288,463 11/1966 Stuart .
4,052,051 10/1977 Mersereau et al. .
4,174,831 11/1979 Marass et al. ..... 271/159

FOREIGN PATENT DOCUMENTS 1099556 2/1961 Germany ..... 271/159
2637086 12/1977 Germany ..... 271/159

*Primary Examiner*—David H. Bollinger
*Attorney, Agent, or Firm*—Herbert L. Lerner; Laurence A. Greenberg

[57] ABSTRACT

A sheet feed for printing presses, in particular for offset presses, has a pile table located between feed side walls. The pile table receives a pile of sheets thereon and it is vertically movable with a main pile lifter. An auxiliary pile lift is provided for uninterrupted sheet delivery when a new pile of sheets is inserted. The auxiliary pile lift has non-stop rails for inserting non-stop rods supporting a residual sheet pile. One vertically movable lift component of the auxiliary pile lift, which is separate from the main pile lift, is disposed on each of the outsides of the two feed side walls. The non-stop rails—optionally together with the lift components—form a frame, which surrounds the feed side walls —or at least portions thereof—on the outside.

17 Claims, 3 Drawing Sheets

SHEET-FEED FOR PRINTING PRESSES

BACKGROUND OF THE INVENTION

Field of the Invention

The invention relates to a sheet feed for printing presses, in particular offset presses, having a pile table for receiving a pile of sheets thereon, the pile table being located between feed side elements and being vertically movable by means of a main pile lifter, and having an auxiliary pile lift for uninterrupted or so-called non-stop sheet delivery when a new pile of sheets is placed therein, the auxiliary sheet lift having non-stop rails for coordinating non-stop rods or the like supporting a residual sheet pile.

Sheet feeds in printing presses serve to separate sheets from a pile of sheets and deliver them to the printing mechanism of the printing press. Because the height of the sheet pile decreases as the withdrawal of sheets progresses, the pile is located on a vertically movable pile table, so that as the pile height decreases, the pile table can be moved correspondingly upwardly, so that the topmost sheets remain within an operative range of a suction head arrangement which takes the sheets from the pile and delivers them to the sheet transport path of the printing press. To assure uninterrupted sheet delivery, a so-called auxiliary pile lift is provided, which receives the residual sheet pile left over from a pile of sheets during the delivery of a new sheet pile. The new sheet pile is placed beneath the residual sheet pile, and the residual sheet pile and the new sheet pile are then combined.

Sheet feeds in printing presses are known in which the pile table which receives the main pile is suspended from support chains which are driven via sprocket wheels. The suspension of the support chains is effected via deflector sprocket wheels, which are supported on a crossbar disposed above the sheet pile. Because of the crossbar, the structure is very high, and the view of the paper stream is obstructed.

So-called compact feeds are therefore also known, in which the structure is somewhat lower, because a crossbar is not required. Instead, feed side walls facing one another at a spaced distance are provided, between which the sheet pile is deposited on a pile table. The pile table rests on vertical guides which are disposed on inner sides of the feed side walls. At the same time, above the pile table, these vertical guides receive lift slide blocks of an auxiliary pile lift; that is, the main pile lift and the auxiliary pile lift both use the same vertical guides. As a result, however, the vertical guides must be relatively long and hence must extend to a corresponding height, because even if the pile table lift slide block is moved far upwardly, there must still be an available region of the guide above this lift slide block in order to receive the lift slide blocks of the auxiliary pile lift. Moreover, it is necessary for the non-stop rails secured to the lift slide blocks of the auxiliary pile lift to be bent downwardly at a right angle, so that non-stop rods to be placed thereon will stay at the correct working height for the residual sheet pile. However, the fact that the guides protrude relatively far upwardly leads to the same disadvantages that exist in sheet feeds with crossbars; that is, both the accessibility and the view are hindered; for an operator standing on an operator platform installed to the side of the feed side wall located on the side of the operator, the view of the paper stream is obstructed. Moreover, the high structural form causes problems in terms of achieving accident prevention.

SUMMARY OF THE INVENTION

It is therefore the object of the invention to create a sheet feed of a compact structural form, which has relatively small height dimensions and a simple construction and which in particular provides free accessibility and viewability for an operator. The low height of the sheet feed also leads to continuous press design; that is, the feed and printing mechanisms can be adapted to the corresponding structural heights of the printing press, and the feed, which has a great construction-dictated height in the prior art, does not disturb the press design.

According to the invention, this object is attained in that one vertically movable lift element of the auxiliary pile lift, which is separate from the main pile lift, is disposed on each of the outsides of the two feed side elements, and that the non-stop rails, optionally together with the lift elements, form a frame, which surrounds the feed side elements or at least portions thereof, on the outside. According to the invention, the elements of the auxiliary pile lift are thus disposed on the outsides of the feed side elements, and as a result, a complete decoupling from the main pile lift exists. The feed side elements are preferably formed as feed side walls. The main pile lift may, for example, have vertical guides which are disposed on the insides of both feed side walls. Guide elements of the vertically movable lift elements of the auxiliary pile lift are conversely provided on the outsides of the two feed side walls, so that the main pile lift and auxiliary pile lift cannot hinder one another, and an overlapping of elements of the main pile lift with those of the auxiliary pile lift is possible, so that a sheet feed with only a very slight structural height is attainable. As a consequence, an unimpeded free view of the paper stream from the operator side is possible, particularly from an operator platform installed in the region of the feed. In order to create bearing surfaces for non-stop rods on the front and rear side of the sheet pile, the lift elements bear a frame, or form parts of this frame, which surrounds the feed side walls, or at least portions thereof, on the outside. The front and rear sides of this frame form the non-stop rails which support the non-stop rods. If the frame does not completely surround the feed side walls on the outside but rather protrudes through corresponding slits in the feed side walls, then only portions of the feed side walls are received in the frame. The invention also makes possible a continuous or through press design, and in particular the realization of a feed form or shape which is likewise contoured and smooth in much the same manner as that of the printing units.

In a further feature of the invention, as already noted, the lift elements can be supported in guides, which are secured to the outsides of the feed side elements. These are preferably roller guides, with the rollers supported on the lift elements and running in guide rails secured to the outsides of the feed side elements.

It is advantageous if the lift elements are secured to support chains, which are driven by means of sprocket wheels, disposed on the outsides of the feed side elements. At least one of the sprocket wheels of each feed side element forms a drive sprocket wheel, and the other sprocket wheels are embodied as deflector sprocket wheels for the associated support chain. The two drive sprocket wheels of the two feed side walls are preferably disposed in a manner fixed against relative rotation on a common drive shaft. This drive shaft is operatively connected with a drive mechanism, in particular an electric motor. In a further feature of the invention, it is provided that on the side of the sheet feed toward the printing press, the associated portion (front non-stop rail) of the frame protrudes through apertures in the feed side walls. This assures that the front non-stop rail comes to rest in front of the corresponding side of the sheet pile, or in other words between the sheet pile and the printing mechanism of the printing press.

On the side of the sheet feed toward the printing press, the associated portion (rear non-stop rail) of the frame is embodied removably. Thus access is unobstructed once the rear non-stop rail is removed.

Preferably, the rear non-stop rail is U-shaped, and its two legs extend approximately parallel to and spaced apart from the outsides of the feed side walls. The rib placed between the two legs of the U-shaped rear non-stop rail covers the face ends of the feed side walls. It is accordingly unnecessary to have apertures in the feed side walls here.

It is advantageous if the outsides of the feed side walls are covered by coverings, which have slits on their face ends for the emergence of the legs of the rear non-stop rail. These coverings are needed for the sake of accident prevention; they cover the chain drives of the auxiliary pile lift. The slits in the coverings, through which the legs of the rear non-stop rail extend, are quite narrow and have close tolerances, so that there is no danger of injury to a human operator.

Preferably, a point connecting the removable rear non-stop rail to the remainder of the frame is located under or substantially under the covering. As a result, no elements protrude from the coverings once the rear non-stop rail is removed.

The guides of the lift elements extend maximally up to the upper edge of the feed side walls. Preferably, they end even before the upper edge, so that the feed side walls close off the sheet feed at the top without protruding parts or the like. For the sake of favorable force distribution, and to counteract a danger of jamming if the frame is slightly skewed, the front non-stop rail is secured in floating fashion to the remainder of the frame. The removable rear non-stop rail also permits a given skewing. The connecting point with the lateral frame elements affords the necessary motion.

Preferably, the legs of the rear non-stop rail are embodied as hollow profile sections, which can be slipped onto receiving mandrels of the lift elements. This makes simple removal and mounting of the rear non-stop rail possible.

The drawings illustrate the invention in terms of an exemplary embodiment; specifically, they show:

DESCRIPTION OF THE PREFERRED EMBODIMENT

Figure 1:
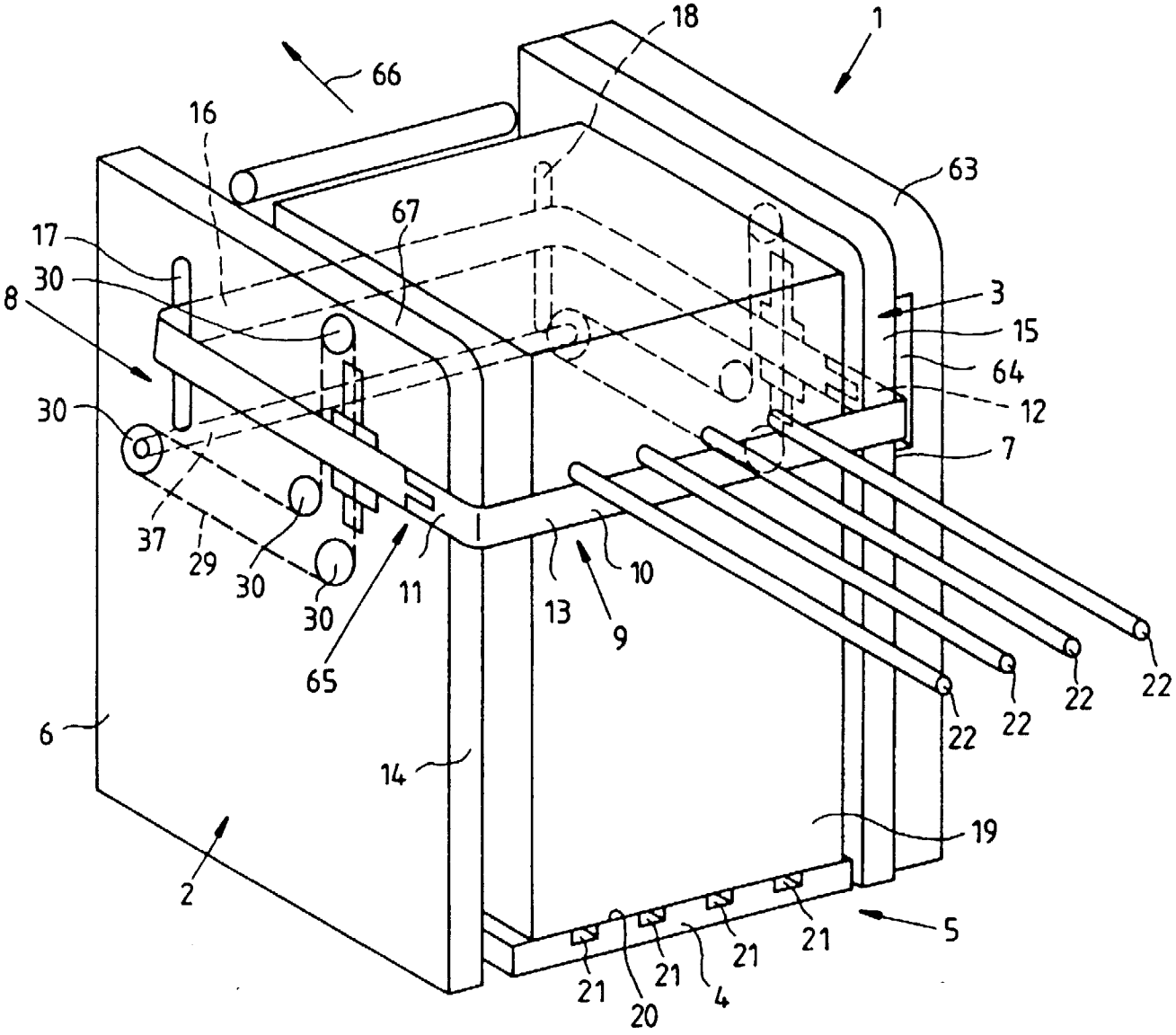
FIG. 1, a schematic perspective view of a sheet feed.

FIG. 1—schematically—shows a sheet feed 1 of a printing press—not shown. The sheet feed 1 has two feed side components formed as walls 2 and 3, spaced apart parallel from one another, between which a vertically movable pile table 4 of a main pile lift 5 is disposed. Components of an auxiliary pile lift 8, which has a frame 9, are disposed on the outsides 6 and 7 of the feed side walls 2 and 3. The frame 9 has a rear non-stop rail 10, which is U-shaped, and its two legs 11 and 12 extend approximately parallel to and spaced apart from the outsides 6 and 7 of the feed side walls 2 and 3. The rib 13 located between the two legs 11 and 12 of the rear non-stop rail 10 covers the face ends 14 and 15 of the feed side walls 2 and 3. Also, on the side of the sheet feed 1 toward the printing press, the frame 9 has a front non-stop rail 16, which extends through apertures 17 and 18 in the feed side walls 2 and 3.

A sheet pile 19 can be disposed on the pile table 4 between the feed side walls 2 and 3. The bearing face 20 of the pile table 4 has longitudinal indentations 21, extending in the direction of the feed side walls 2 and 3, which serve—as in the auxiliary pile mode—to receive non-stop rods 22. The mode of operation will be described in further detail hereinafter.

Figure 2:
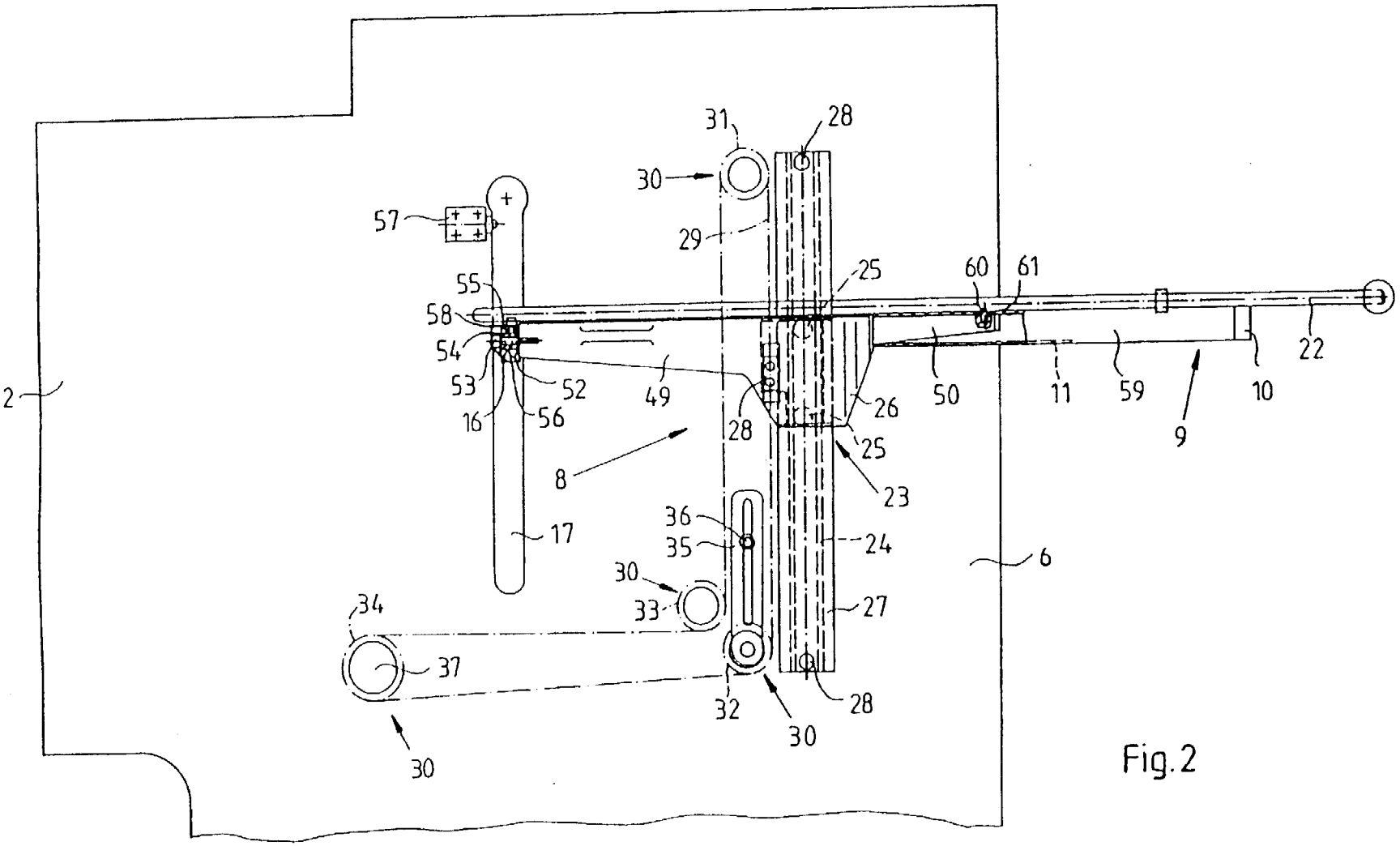
FIG. 2, a side view of the sheet feed.

FIG. 2 shows a side view on the feed side wall 2 and on the elements associated with this feed side wall 2 of the auxiliary pile lift 8. The following description applies correspondingly to the embodiment of the feed side wall 3 and the parts of the auxiliary pile lift 8 located there, so that it will suffice to describe only the feed side wall 2 of FIG. 2.

A roller guide 23 is disposed on the outside 6 of the feed side wall 2; it has a U-shaped guide rail 24, in which rollers 25 of a vertically rotatable lift element 26 of the auxiliary pile lift component or 8 are supported. The U-shaped guide rail 24 is screwed by its back rib to the outside 6 of the feed side wall 2. The rollers 25 are supported rotatably on the lift component or element 26, so that the latter is supported, movable vertically up and down, on the outside 6 of the feed side wall 2. The lift element 26 is covered along the roller guide 23 by a securing rib 27, which is retained on the outside 6 of the feed side wall 2 by means of spacer bolts 28. Located laterally next to the guide rail 24 on the lift element 26 is a securing point 28 a support chain 29, which is wrapped in a closed loop around sprocket wheels 30. One of the sprocket wheels 30 is located at the upper end laterally next to the guide rail 24. It forms a deflector sprocket wheel 31. A further one of the sprocket wheels 30, also embodied as a deflector sprocket wheel 32, is located—below the deflector sprocket wheel 31—in the region of the lower end of the roller guide 23. Quite close to the deflector sprocket wheel 32 is a further one of the sprocket wheels 30, embodied as a deflector sprocket wheel 33. Finally, offset laterally from the deflector sprocket wheel 32 in the direction toward the printing press, there is the sprocket wheel 30, which forms a drive sprocket wheel 34. All the sprocket wheels 30 are located on the outside 6 of the feed side wall 2, and they are disposed such that the loop of the support chain 29 forms a "double" L. For tensioning the support chain 29, the deflector sprocket wheel 32 is secured to a slide block 35, which is movable parallel to the roller guide 23 and can be fixed by means of a screw 36.

Figure 3:
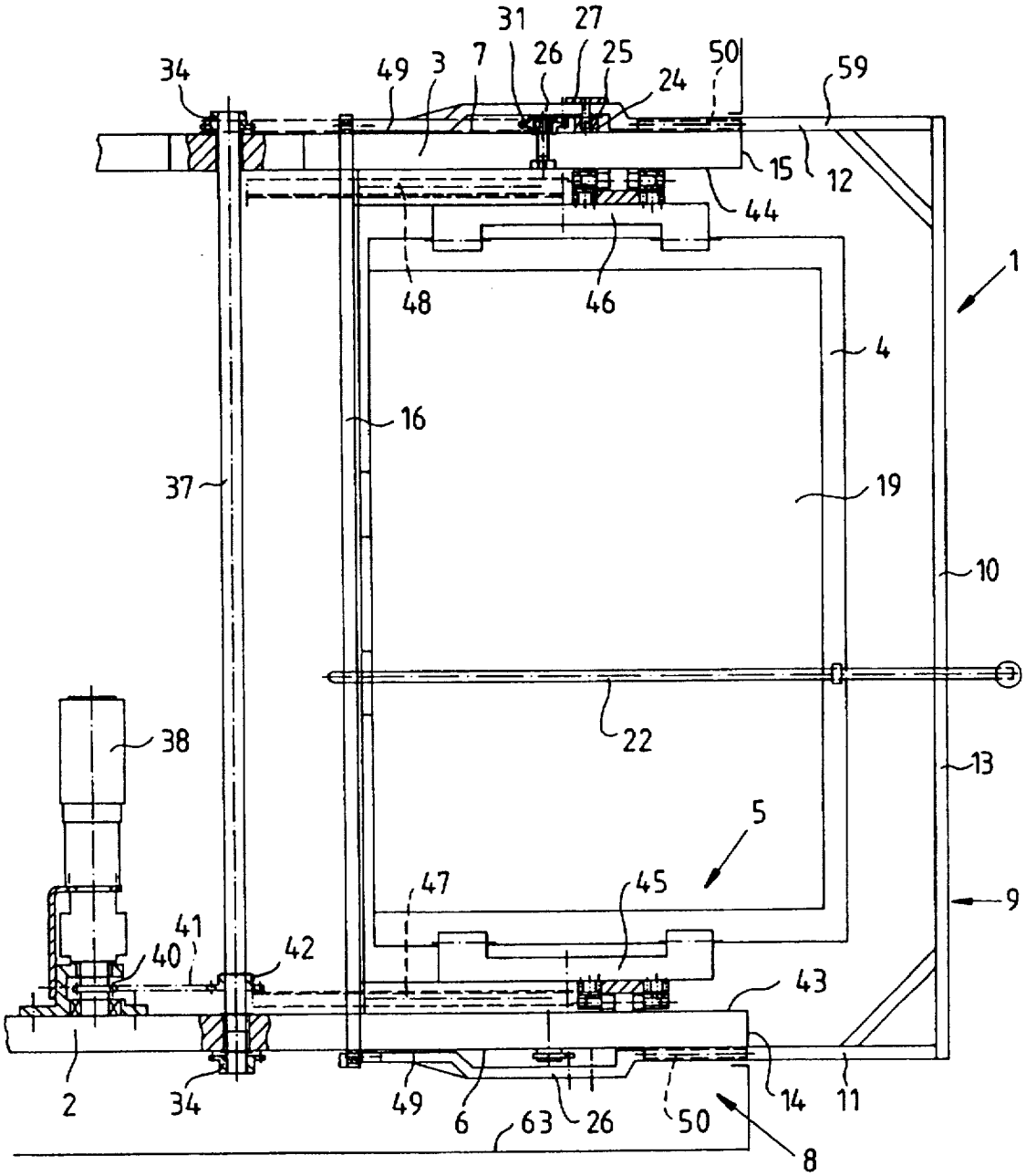
FIG. 3, a plan view (partly in section) of the sheet feed.

FIG. 3 shows that the two sprocket wheels 34 of the two feed side walls 2 and 3 are disposed in a manner fixed against relative rotation on a common drive shaft 37, which is located between the sheet pile 19 and the printing mechanism, not shown, of the printing press. A servo-motor 38 has a sprocket wheel 40, which is connected via an adjusting chain 41 to a sprocket wheel 42 which is disposed on the drive shaft 34 in a manner secured against relative rotation. Both the servo-motor 38 and the sprocket wheels 40 and 42, as well as the adjusting chain 41, are disposed between the two feed side walls 2 and 3.

Lift slide blocks 45 and 46 are supported vertically movably on the insides 43 and 44 of the feed side walls 2 and 3 and are joined to the pile table 4 (not shown in FIG. 3). Via lifting chains 47 and 48 and other driving and deflector elements, not shown, the lift slide blocks 45 and 46 can be displaced in accordance with the desired position of the pile table 4.

The lift element 26 has an arm 49 and a receiving mandrel 50; the arm 49 extends as far as a slit-like aperture 17 in the feed side wall, and the receiving mandrel 45 extends up to the level of the face end 14 of the feed side wall 2. The front non-stop rail 16 is secured in floating fashion to one face end 52 of the arm 49. For that purpose, a shim 54 and a bushing 55 are secured to the face end 52 by means of a screw 53, and the front non-stop rail 16 receives the bushing 55 in a bore 56 which has a diameter greater than the diameter of the bushing 55. The thickness of the front non-stop rail 16 is less than the length of the bushing 55, so that the overall result is a floating connection between the arm 49 and the non-stop rail 16.

End switches 57 are disposed in the upper and lower regions of the slitlike aperture 51; they cooperate with an actuation plate 58 of the front non-stop rail 16. The end switches 57 turn off the servo-motor 38 when the uppermost or lowermost position of the lift element 26 and hence of the frame 9 has been reached.

The rear non-stop rail 10 is formed as a hollow profile section 59, which can be slipped into the receiving mandrel 50 of the lift element 26. The receiving mandrel 50 has a wedge-like shape, so that a tilting motion of the hollow profile section 59 is possible so that a pin 60 protruding from the receiving mandrel 50 can enter into a receiving bore 61 of the hollow profile section 59 to prevent it from being pulled off. Swiveling the hollow profile section 59 upwardly causes the pin 60 to emerge from the receiving bore 61, and the hollow profile section 59, or in other words the rear non-stop rail 10, can now be removed.

The two outer sides 6 and 7 of the feed side walls 2 and 3 are covered by covers 62 and 63, which cover the drive elements and so forth of the auxiliary pile lift 8 and which have slits 64 on their face ends, from which the rear non-stop rail 10 protrudes. The connecting point 65 between the rear non-stop rail 10 and the respective lift element 26 is located under the applicable covering 62 or 63.

The sheet feed according to the invention functions as follows:

It is assumed at the outset that a sheet pile 19 is placed between the feed side walls 2 and 3 (FIG. 1). The non-stop rods 22 shown thereat, and the rear non-stop rail 10 as well, are assumed to be removed. It is also assumed that a suction head arrangement, not shown, takes the respective uppermost sheet from the sheet pile 19 and delivers it to the printing press, in the direction of the arrow 66 (FIG. 1). This causes the pile height to decrease, which is detected by a sensor which actuates the main pile lift and, as a result, the pile table 4 and hence the sheet pile 19 move incrementally upwardly. The instant there is only a small height of the sheet pile 19 remaining, a human operator slides the non-stop bars 22 into the longitudinal indentations 21 and then actuates the auxiliary pile lift 8, so that the frame 9 moves upwardly, and the rear non-stop rail 10 and the front non-stop rail 16 both move from below towards the protruding ends of the non-stop rods 22. In this way, a residual sheet pile is located on the non-stop rods 22 and can be replenished as operation continues by means of the auxiliary pile lift 8, at the rate of sheet removal. At the same time, by actuation of the main pile lift 5, the pile table 4 is moved downwardly and a new sheet pile is introduced. This new sheet pile 19 is then raised, so that it comes to rest with its top just below the non-stop rod 22.

Next, the non-stop rods 22 can be pulled out by the human operator, so that a new complete pile is formed. The above description shows that, as a result, uninterrupted sheet delivery is possible.

I claim:

1. A sheet feed for a printing press, comprising:

a pile table for supporting thereon a pile of sheets, and feed side components laterally bounding said pile table;

a main pile lift for vertically moving said pile table;

and an auxiliary pile lift for facilitating uninterrupted sheet delivery to the printing press when a new pile of sheets is inserted at said pile table;

said auxiliary pile lift including non-stop rails and non-stop rods supported in said non-stop rails, said non-stop rods bearing a residual sheet pile;

said auxiliary pile lift further including vertically movable lift components separate from said main pile lift, one of said lift components each being disposed laterally outside each of said feed side components; and said non-stop rails defining a frame surrounding at least portions of said feed side components.

2. The sheet feed according to claim 1, wherein said frame includes said lift components.

3. The sheet feed according to claim 1, which further comprises guide rails mounted outside at said feed side components, said lift components being vertically shiftable in said guide rails.

4. The sheet feed according to claim 3, wherein said feed side components are feed side walls with upper edges, and wherein said guide rails of said lift components extend maximally up to said upper edges of said respective feed side walls.

5. The sheet feed according to claim 1, which further comprises support chains to which said lift components are secured, and sprocket wheels driving said support chains disposed laterally outside at said feed side components.

6. The sheet feed according to claim 5, wherein said feed side components are sheet feed side walls, and at least one of said sprocket wheels is a driven sprocket wheel, and the other of said sprocket sheets are deflector sprocket wheels.

7. The sheet feed according to claim 6, which further comprises a common drive shaft connected between said at least two driven sprocket wheels for fixing said at least two driven sprocket wheels against relative rotation.

8. The sheet feed according to claim 1, wherein said feed side components are sheet feed side walls.

9. The sheet feed according to claim 1, wherein said feed side components are sheet feed side walls with ends facing towards the printing press, and said sheet feed side walls have apertures formed therein at the ends thereof facing towards the printing press, and a forward portion of said frame, as seen in the direction of sheet feed, protruding through said apertures.

10. The sheet feed according to claim 1, wherein said frame is formed by a forward non-stop rail proximally of the printing press, two lateral frame portions extending along said feed side components, and a rear non-stop rail distally of the printing press, said rear non-stop rail being removable from said frame.

11. The sheet feed according to claim 10, wherein said feed side components are feed side walls, and wherein said rear non-stop rail is U-shaped, with two legs attaching to said lateral frame portions and extending approximately parallel to and laterally spaced apart from said feed side walls.

12. The sheet feed according to claim 11, wherein said rear non-stop rail has a rib between said two legs, said rib covering respective end faces of each of said feed side walls.

13. The sheet feed according to claim 11, which further comprises lateral cover walls disposed laterally outside said feed side walls, said cover walls having end faces distally of the printing press and voids formed in said end faces for receiving said legs of said rear non-stop rail.

14. The sheet feed according to claim 13, wherein said rear non-stop rail is connected into said frame at connection points disposed laterally of said feed side walls, each said connection point being disposed inside a space defined between said respective lateral cover wall and said feed side wall.

15. The sheet feed according to claim 10, wherein said forward non-stop rail is secured to said lateral frame portions in floating fashion.

16. The sheet feed according to claim 10, wherein said rear non-stop rail is secured to said lateral frame portions in floating fashion.

17. The sheet feed according to claim 11, which further comprises receiving mandrels formed on said lift components, and wherein said legs of said rear non-stop rail are hollow profile sections adapted to be slipped onto said receiving mandrels.

* * * * *